US008425277B2

(12) United States Patent
Jansson

(10) Patent No.: US 8,425,277 B2
(45) Date of Patent: Apr. 23, 2013

(54) DEVICE FOR SHARPENING A TWIST DRILL POINT AND A METHOD FOR ITS USE

(75) Inventors: Torgny Jansson, Lindesberg (SE); Margereta Norin Jansson, legal representative, Lindesberg (SE)

(73) Assignee: TJ Utveckling AB, Lindesberg (SE)

( * ) Notice: Subject to any disclaimer, the term of this patent is extended or adjusted under 35 U.S.C. 154(b) by 203 days.

(21) Appl. No.: 13/000,571

(22) PCT Filed: Jun. 24, 2009

(86) PCT No.: PCT/SE2009/050801

§ 371 (c)(1),
(2), (4) Date: Apr. 1, 2011

(87) PCT Pub. No.: WO2009/157867

PCT Pub. Date: Dec. 30, 2009

(65) Prior Publication Data

US 2011/0171884 A1 Jul. 14, 2011

(30) Foreign Application Priority Data

Jun. 26, 2008 (SE) ..... 0801504

(51) Int. Cl.
*B24B 3/26* (2006.01)

(52) U.S. Cl.
USPC ..... 451/48; 451/375

(58) Field of Classification Search ..... 451/48, 451/375, 376, 213, 241
See application file for complete search history.

(56) References Cited

U.S. PATENT DOCUMENTS

| | | | | |
|---|---|---|---|---|
| 3,357,138 | A * | 12/1967 | Young | 451/72 |
| 3,808,748 | A * | 5/1974 | Gunnerson | 451/375 |
| 4,176,499 | A | 12/1979 | Mazoff | |
| 4,646,474 | A | 3/1987 | Chen | |
| 5,649,853 | A * | 7/1997 | Kuo | 451/178 |
| 6,244,938 | B1 * | 6/2001 | Ploeger | 451/65 |

FOREIGN PATENT DOCUMENTS

| | | |
|---|---|---|
| DE | 28 33 420 | 2/1980 |
| DE | 29 15 601 | 10/1980 |

* cited by examiner

*Primary Examiner* — Robert Rose
(74) *Attorney, Agent, or Firm* — Merchant & Gould P.C.

(57) ABSTRACT

A device for sharpening a twist drill point by means of a rotating grindstone (12) in a grinding machine comprises a base plate (14) lockably articulated around an axis parallel with the axis of the grindstone (12), a drill holder (16) for releasably holding a twist drill (1) to be sharpened, and a guide member (15). The guide member has a back plate (21) and a front plate (22), lockably rotatable in relation to each other. The back plate (21) is connected to the base plate (14) for movements in the direction of the grindstone axis, and the front plate (22) has guide means (28, 29) for slidably guiding the drill holder (16) in the general direction towards and away from the grindstone (12).

9 Claims, 5 Drawing Sheets

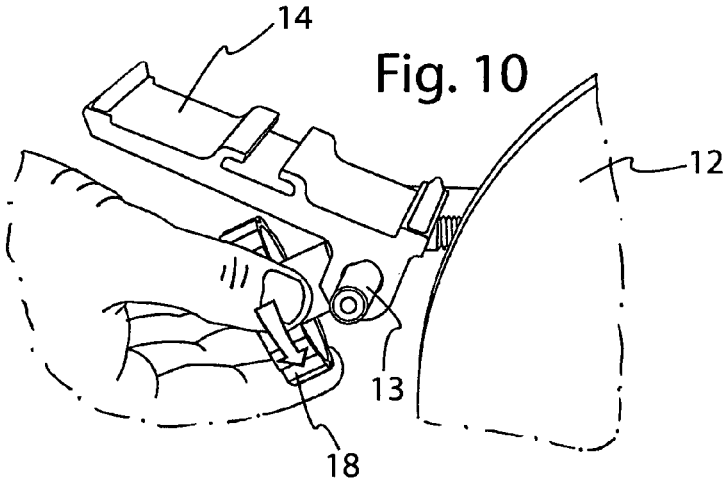
Fig. 10
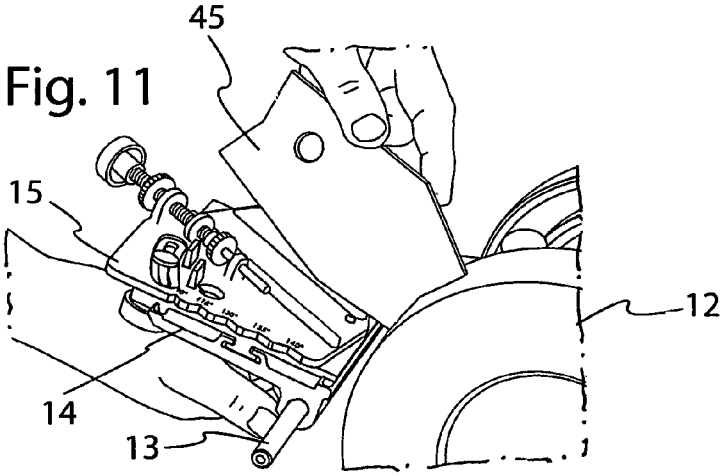
Fig. 11
Fig. 12
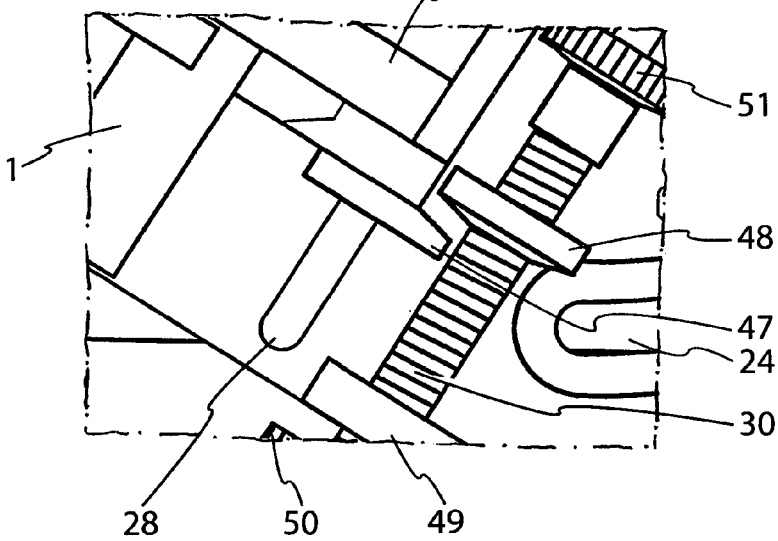

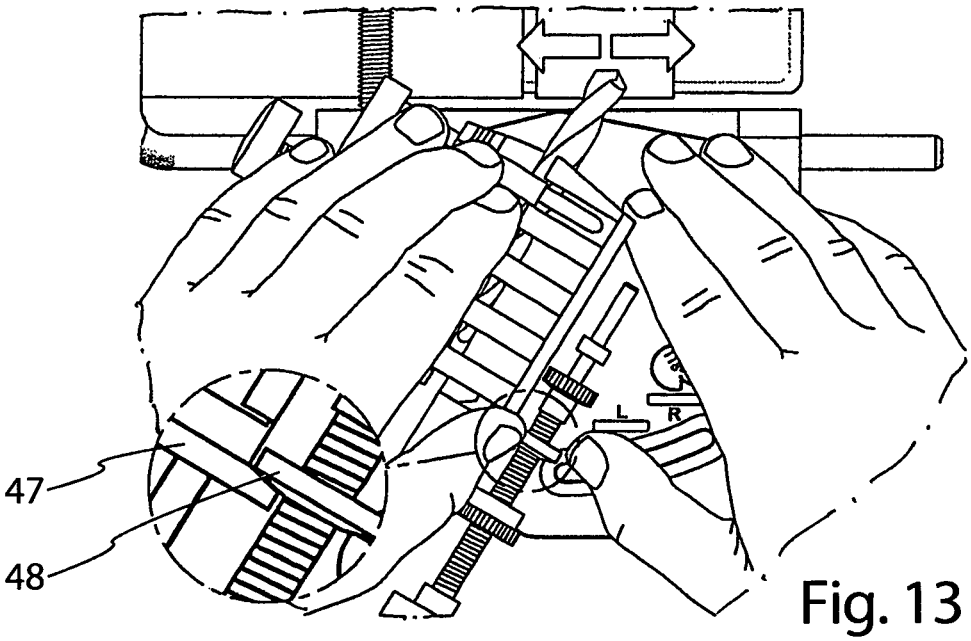
Fig. 13
Fig. 14
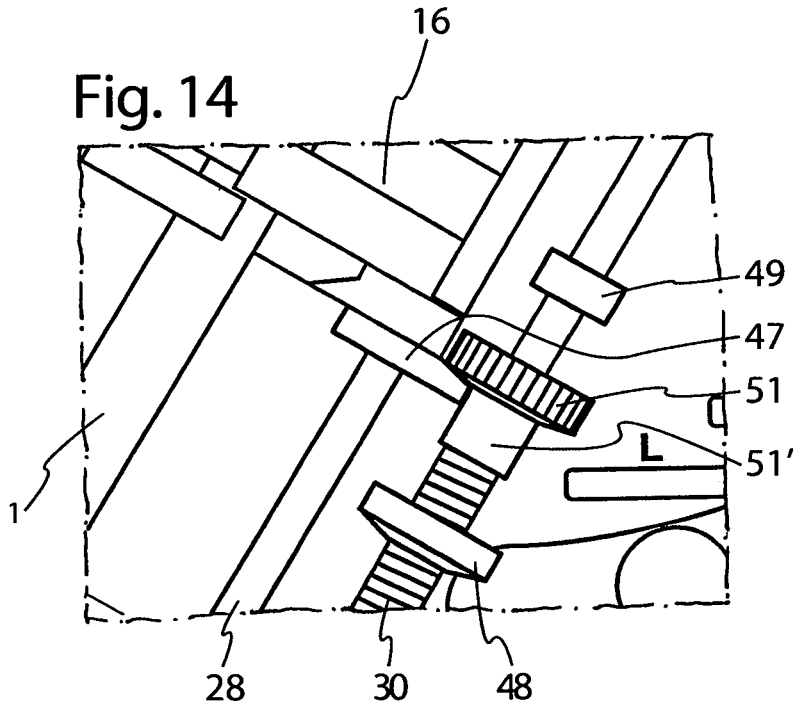

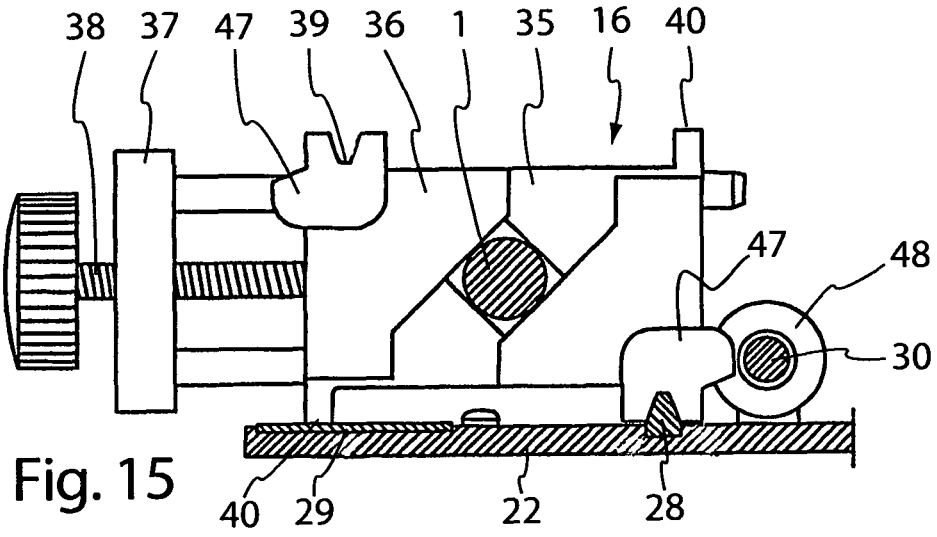
Fig. 15
Fig. 16
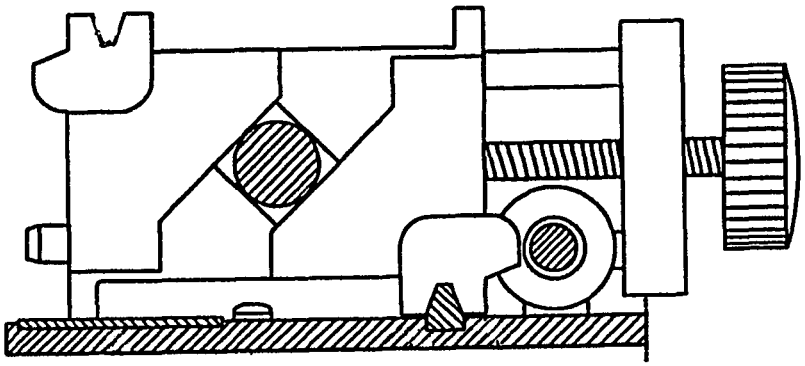

DEVICE FOR SHARPENING A TWIST DRILL POINT AND A METHOD FOR ITS USE

This application is a National Stage Application of PCT/SE2009/050801, filed 24 Jun. 2009, which claims benefit of Serial No. 0801504-2, filed 26 Jun. 2008 in Sweden and which applications are incorporated herein by reference. To the extent appropriate, a claim of priority is made to each of the above disclosed applications.

TECHNICAL FIELD

The present invention relates to a device for sharpening a twist drill point by means of a rotating grindstone in a grinding machine. It also relates to a method for the use of this device.

BACKGROUND OF THE INVENTION

It is of great importance for a good drill result to utilize a well sharpened twist drill. Twist drills can be sharpened in different ways, but the present invention is applicable to the use of a rotating grindstone in a grinding machine.

A device for sharpening a twist drill point shall preferably be as simple as possible in its design, but shall yet provide a good end result without requiring expert skills by the user. A low price is of advantage. It is preferred not only to enable a so called cone envelope sharpening but also the more complex but better four facet sharpening.

THE INVENTION

This may according to the invention be obtained by the combination of

- a base plate lockably articulated around an axis parallel with the axis of the grindstone,
- a drill holder for holding a twist drill to be sharpened, and
- a guide member, comprising a back plate and a front plate, lockably rotatable in relation to each other,
  - the back plate being connected to the base plate for movements
  - in the direction of the grindstone axis, and
  - the front plate having guide means for slidably guiding the drill holder in
  - the general direction towards and away from the grindstone.

The base plate may preferably have a longitudinal bore for a cylindrical support bar of the grinding machine, a locking screw being engageable in the bore, and a support ridge for sliding cooperation with a guide groove on the lower side of the back plate.

For obtaining the necessary guiding of the drill holder on the guide member, the front plate of the guide member has a guide ridge for cooperation with a guide groove in the drill holder and a guide plane for cooperation with a support strip on the drill holder.

In a manner known per se, the drill holder may comprise two clamping members, between which the twist drill may be clamped by means of a screw. The drill holder may be provided with guide grooves and support faces on two opposed surfaces for enabling a turning 180°.

The front plate of the guide member is rotatable in relation to its back plate for enabling a setting of the desired point angle of the twist drill. The back plate and the front plate of the guide member may after this setting be locked together by means of a back plate screw, and the setting may be simplified in that the front plate has a sight hole for showing angle numbers provided on the back plate.

For enabling control over the sharpening process, an adjustment screw provided on the front plate in parallel with the guide ridge may have a fixed shoulder and a movable stop nut for cooperation with a heel on either side of the drill holder.

A separate template may be used for determining the angular position of the base plate with the guide member or in other words for determining the primary clearance angle.

In order to sharpen a twist drill point to an ordinary cone envelope point by means of a device according to the invention the following steps can be performed:

- after mounting on the cylindrical support bar parallel with the axis of the grindstone, the base plate is provided with the slidable guide member, and their angular position in relation to the grindstone, determining the primary clearance angle of the twist drill to be sharpened, is set by means of the template and locked,
- the desired point angle of the drill to be sharpened is determined by rotating the front plate of the guide member in relation to its back plate and locking it in the chosen position,
- the twist drill is mounted in the drill holder with its cutting lips in parallel with the side surfaces of the drill holder, and the drill holder is placed on the guide member with its heel in contact with the shoulder on the adjustment screw in a position where the drill point contacts the grindstone,
- after advancement of the adjustment screw shoulder a distance corresponding to the desired cutting depth, one of the cutting lips is sharpened by pushing the drill holder towards the grindstone, while moving the drill point back and forth over the width of the grindstone, until the heel has reached contact with the shoulder, and
- the drill holder is turned around and returned to the guide member, whereupon the above sharpening procedure is repeated.

In order to obtain a more advanced four facet sharpening the following further steps can be performed:

- the base plate is lifted somewhat to form a greater angle with the tangent of the grindstone and locked in the new position,
- the drill holder is lifted and placed in a new position on the guide member with the heel in contact with the stop nut,
- a sharpening process for forming a secondary clearance at one of the cutting lips is performed,
- the drill holder is turned, and the sharpening process is repeated for the other cutting lip, and
- the above process is repeated, until the secondary clearances meet in the centre and a real drill point is created.

It is believed that the device according to the invention enables a sharpening technique which is superior to conventional methods. The twist drill can be sharpened to a four facet point, which provides the best cutting conditions. The drill makes its way better than a new, conventional drill and does not wander in the beginning of the drilling. It has been shown that a four facet sharpened drill can drill a hole more than twice as fast than a conventional drill with the same thrust. This is especially of advantage at the drilling with a handheld machine.

By a controlled grinding of a secondary clearance at a four facet sharpening, the drill will obtain a real point, which means that it cuts more easily and does not wander. The two cutting lips of the drill will have exactly the same length, which means that they share the work equally. The resulting bore will be exact and have the same diameter as the drill. The life of the drill will be extended.

Independently of whether the drill is sharpened to a cone envelope point or a four facet point, it will be sharpened with the optimal primary clearance angle for each condition (which depends on the drill diameter and the drilled material).

It is easy to adapt the device to any point angle between 90° and 140°. The device can handle at least drill diameters between 3.5 and 20 mm and drills in HSS materials and tungsten carbide.

BRIEF DESCRIPTION OF THE DRAWINGS

The invention will be described in further detail below under reference to the accompanying drawings, in which FIG. 10 illustrates an early stage in the mounting of the device shown in FIG. 5, FIG. 11 illustrates a later stage in the mounting of the device shown in FIG. 5, FIG. 12 illustrates the cooperation between a heel and a shoulder at the initial sharpening process, FIG. 13 illustrates the use of the device shown in FIG. 5, FIG. 14 illustrates the cooperation between the heel and a stop nut at a later stage of the sharpening process, and FIGS. 15 and 16 are end views of the drill holder in two positions on the guide member.

DESCRIPTION OF EMBODIMENTS

The present invention relates to the grinding or sharpening of a twist drill point.

Figure 1:
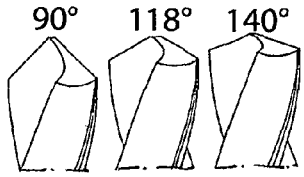
FIG. 1 illustrates different point angles of a twist drill.

A twist drill may have a point angle of between 90° and 140°, and three point angles of 90°, 118° and 140° are illustrated in FIG. 1. The most usual point angles are 118° or 130°, but point angles of 120°, 135° and 140° can be found. Harder steel and stainless steel require larger point angles, which is also true for aluminium, whereas center drills most often have a point angle of 90°.

Figure 2:
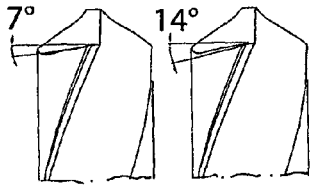
FIG. 2 illustrates different primary clearance angles of a twist drill.

A twist drill must have a correct primary clearance angle in order to function. It is illustrated in FIG. 2 that this clearance angle may vary between say 7° and 14°. A drill with larger clearance angle will cut more easily, but if the angle is too large, the drill will tend to vibrate, to cut in a jerky way and to soon get worn. If on the other hand the clearance angle is too small, the drill does not cut but becomes hot with a resulting deterioration of the cutting edges or lips.

The optimal clearance angle depends on the material and the dimension of the drill. A harder material requires a drill with smaller clearance angle. A thicker drill shall have a smaller clearance angle than a more slender one. Every drill dimension accordingly has an optimal clearance angle, where it works in the best possible way with regard to the drilled material.

Figure 3:
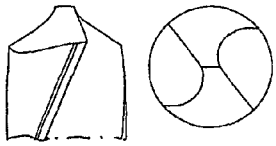
FIG. 3 illustrates in two views a conventional twist drill with a chisel edge.

Conventional drills are usually ground with a so-called cone envelope point. As is shown in FIG. 3, the two cutting lips are somewhat offset in the center and form a chisel edge. This drill geometry, however, is not ideal, as the chisel edge has to push its way down through the material to drill, which consumes much of the thrust, before the cutting lips start to cut. As the chisel edge lacks a point, the drill will wander around when trying to cut a non-predrilled hole.

Other point sharpening methods are available for obtaining a better result with regard to i a the ability for the drill to be centered. Such methods, however, have to be performed in expensive special machinery, only available in a few workshops, and the sharpening is too expensive for ordinary work.

Figure 4:
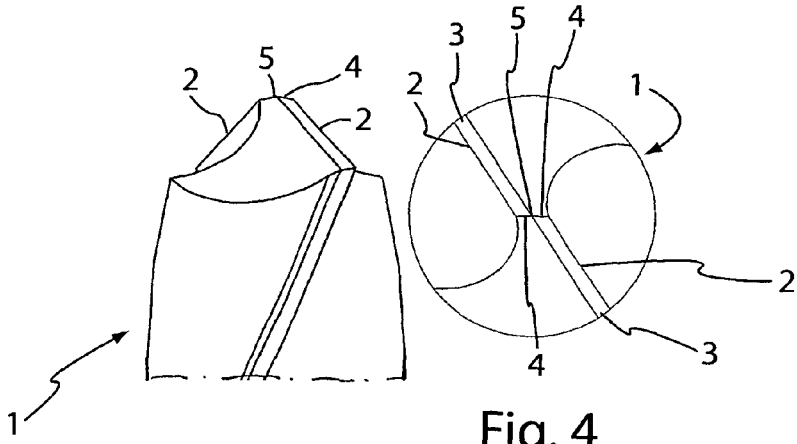
FIG. 4 illustrates in two views and to a larger scale a twist drill with a four facet point.

A better geometry for a twist drill 1 is obtained by four facet sharpening, which is illustrated in FIG. 4. The two cutting lips 2 are ground with planar surfaces or secondary clearances 3 and are beveled. The two cutting lips 2 are in line with each other, and the chisel edge 4 obtains a point 5. Such a drill does not wander. A four facet sharpening will decrease the required thrust and the resulting heat development into half as compared to a conventional drill with cone envelope sharpening. A point with four facet sharpening will cut better and have a longer life.

Four facet sharpening is uncommon at mass production due to higher manufacturing costs, but can primarily be used for tungsten carbide drills.

The device according to the invention enables a four facet sharpening of a twist drill to be obtained in a conventional grinding machine or in a special machine equipped with such a device.

Figure 5:
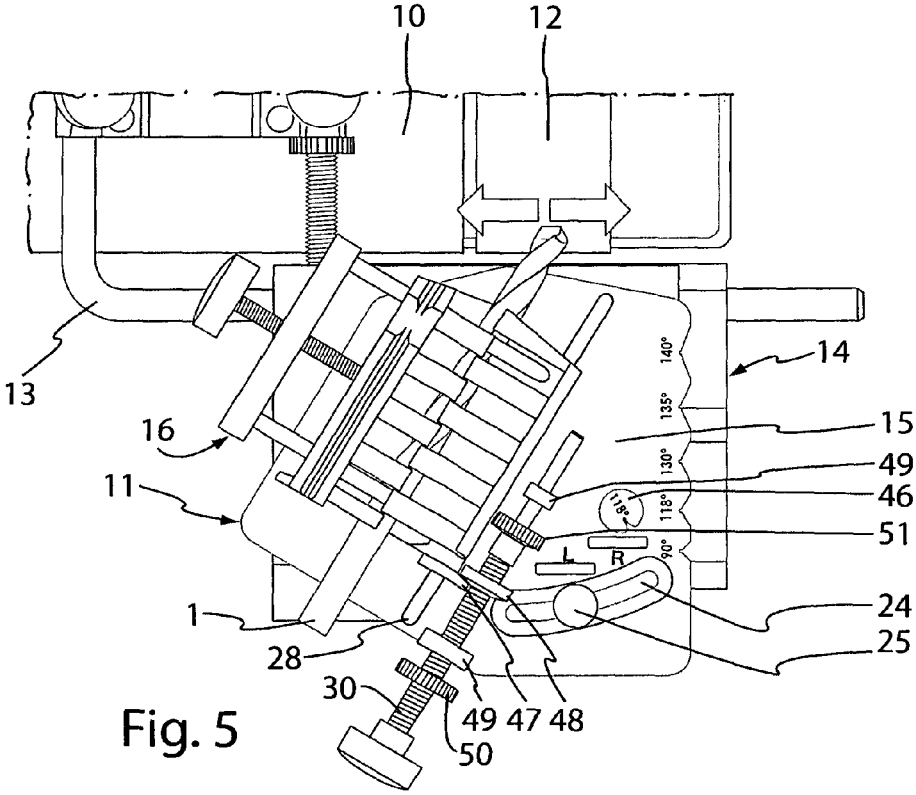
FIG. 5 is a top view of a conventional grinding machine with a device according to the invention for sharpening the point of a twist drill.

A portion 10 of a conventional grinding machine provided with a device 11 according to the invention is shown in FIG. 5. The machine has a circular or disc-shaped grindstone 12 driven for rotation by an electric motor in the machine. The machine is also provided with a cylindrical support bar 13, called a universal support, which is parallel with the rotation axis of the grindstone 12. The position of the universal support 13 can be adjusted to suit different purposes at grinding or sharpening by the grindstone 12 of different tools, normally edge tools but thus also twist drills.

Figure 6:
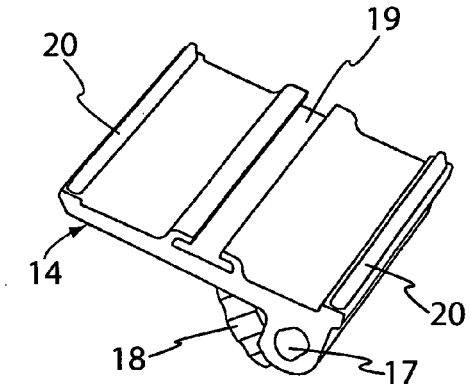
FIG. 6 is an isometric view of a base plate for the device shown in FIG. 5.
Figure 7:
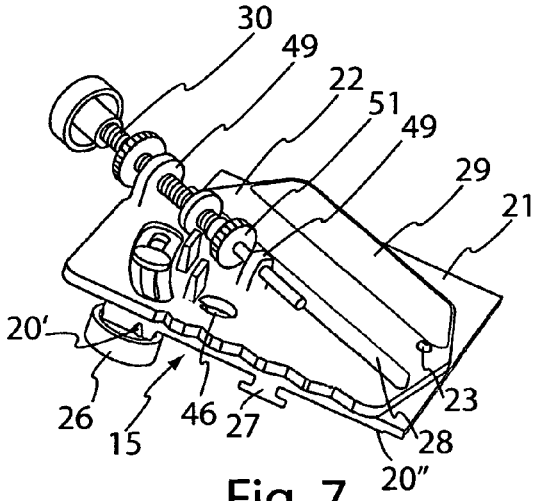
FIG. 7 is an isometric view of a guide member for the device shown in FIG. 5.
Figure 8:
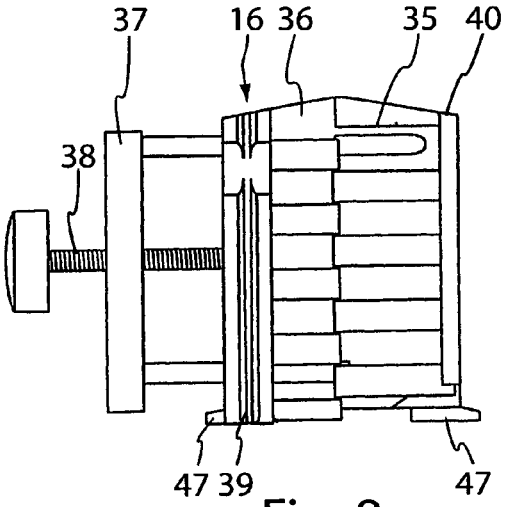
FIG. 8 is a top view of a drill holder for the device shown in FIG. 5.

The device 11 according to the invention comprises the following main parts: a base plate 14, shown in FIG. 6, a guide member 15, shown in FIG. 7, and a drill holder 16, shown in FIG. 8.

At its lower side the base plate 14 has a longitudinal bore 17 for its mounting in any desired rotational position on the universal support 13. The base plate 14 may be locked in the desired position by means of a screw 18. On its upper side the base plate 14 is provided with a guide channel 19 parallel with the bore 17 as well as two support ridges 20 for supporting the guide member 15.

The guide member 15 basically comprises a back plate 21 and a front plate 22, which are rotatable in relation to each other about an axis 23. The front plate 22 is provided with an arcuate groove 24, in which a back plate screw 25 provided with a knob 26 engages, so that the rotational position of the front plate 22 in relation to the back plate 21 may be locked.

The back plate 21 is provided with a guide ledge 27 on its lower side for sliding engagement with the guide channel 19 of the base plate 14. It is also provided with a conical guide groove 20' for guiding cooperation with the left support ridge 20 in FIG. 6 as well as a support plane 20" for the right support ridge 20.

The front plate 22 is on its upper side provided with a guide ridge 28 and a guide plane 29, together forming guide means for the drill holder 16. It is also provided with an adjustment screw 30 to be further described below.

The drill holder 16, which per se is conventional, basically comprises two clamping members 35 and 36 with suitable notches in their surfaces facing each other for receiving a drill 1, as is illustrated in FIGS. 5 and 13. The clamping members 35 and 36 can be transferred and are guided in relation to each other by means of a yoke 37 and a screw 38.

On both its upper side shown in FIG. 8 and its lower side the drill holder 16 is provided with a guide groove 39 and a support strip 40 for engagement with the guide ridge 28 and the guide plane 29, respectively, on the front plate 22 of the guide member 15.

Further features of the device will appear from the following description of the process for sharpening a twist drill by means of the device.

Prior to mounting the device, the universal support 13 is to be positioned at a suitable distance, say 16 mm, from the grindstone 12. For this purpose a template 45—to be described below—has a hole 45' with a diameter corresponding to that of the universal support, so that the template 45 can be used as a jig for determining this distance in a simple way.

An early step in the preparation for the sharpening of a twist drill point is illustrated in FIG. 10. The base plate 14 is treaded onto the universal support 13 and preliminary attached thereto by means of the screw 18. The guide member 15 is treaded onto the base plate 14, as is illustrated in FIG. 11.

Figure 9:
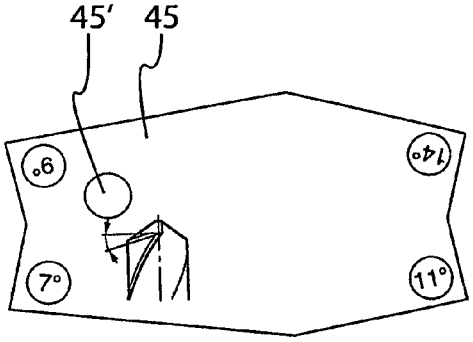
FIG. 9 shows a template for use together with the device shown in FIG. 5.

A desired primary clearance angle (see FIG. 2) is obtained by adjusting the angular position of the base plate 14 on the universal support 13. This adjustment is simplified by a template 45 shown in FIG. 9 and also in FIG. 11. By means of the shown template, clearance angles of 7°, 9°, 11° and 14° can be obtained. Four side edges of the template 45 have these angles in relation to a centerline of the template. The side edge corresponding to the desired angle is laid against the upper side of the guide member 15, and the angular position of the base plate 14 is adjusted, until two end points of the template 45 are in contact with the grinding wheel 12, these two end points being on a line perpendicular to the centerline of the template 45. The screw 18 is tightened.

The adjustment aided by the template 45 provides for a correct clearance angle irrespective of the wear (or diameter) of the grinding wheel 12.

The next step is to set the point angle of the drill. This is done by adjusting the mutual rotational position between the back plate 21 and the front plate 22 of the guide member 15. As is most clearly shown in FIG. 5, a side edge of the front plate of the guide member 15 may be provided with notches with certain typical point angles, in the shown case 90°, 118°, 130°, and 140°. Hereby, the prevailing point angle of the drill can be assessed. Hereafter the front plate 22 may be rotated and locked in the desired position by means of the screw 26 (FIG. 7). The back plate 21 is for this purpose provided with angle numerals visible through a sight hole 46 in the front plate 22 (FIGS. 5 and 7).

Hereafter the drill to sharpen is attached in the drill holder 16 with its point extending out from the drill holder a certain distance, which may be determined by the distance between either of two stops L and R and the edge of the front plate 22 of the guide member 15 (L for point angles between 118° and 140° and R for a point angle of 90°).

The drill 1 is to be attached in the drill holder 16 with its cutting lips 2 parallel with the upper and lower sides of the drill holder 16. Reference is here also made to FIGS. 15 and 16.

It is now time to apply the drill holder 16 on the guide member 15. The drill holder 16 is provided with a heel 47 at each side. The relevant heel 47 is to be brought in contact with a shoulder 48 on the adjustment screw 30, which is carried by two ears 49 on the front plate 22 of the guide member 15. The adjustment screw 30 is now forwarded towards the grindstone 12 by rotation, until the drill point is say 1 mm from the grindstone, which hereafter may be started in its rotational movement. Further advancement of the adjustment screw 30 will bring the drill point into contact with the grindstone 12; the sound will indicate when the drill point touches the grindstone. The arrangement is now in a zero position.

The adjustment screw 30 is now advanced a distance corresponding to the desired cutting depth of the drill point. The design of the adjustment screw 30 may be such that one revolution corresponds to 0.5 mm cutting depth. Hereby, the said distance occurs between the heel 47 and the shoulder 48, as is shown in FIG. 12. The adjustment screw 30 can now be locked by means of a locking nut 50 engaging one of the ears 49.

The sharpening of the first cutting lip of the drill point is now commenced, as is illustrated in FIG. 13. The drill holder 16 is pushed down against the guide member 15 and advanced, so that the drill point gets in sharpening contact with the rotating grindstone 12. The drill holder 16 on the guide member 15 is moved laterally back and forth on the base plate 14, so that the entire width of the grindstone 12 is utilized. This sharpening continues, until the heel 47 again gets in contact with the shoulder 48, preventing further advancement.

The drill holder 16 is now lifted from the guide member 15 and turned 180°. The sharpening procedure is repeated for the second cutting lip of the drill point.

The entire sharpening procedure can be repeated some times in order to obtain the same sharpening for both cutting lips. The sharpening sound will tell, when the cutting lips have received the same sharpening.

The result so far is that the drill has received cutting lips with a symmetrical point angle, of the same length and with the desired primary clearance angle.

It is now time to continue the sharpening process for providing the drill point with the desired secondary clearance angle and with the four facet sharpening.

The first step in this process is to loosen the screw 18, so that the base plate 14 with the guide member 15 and the drill holder 16 can be rotated somewhat counter-clockwise, which means that the drill point leaves its contact with the grindstone 12, and then locked again (as viewed in for example FIG. 10).

The drill holder 16 is to be lifted and placed in a new position on the guide member 15 with the heel 47 in contact with a stop nut 51 in thread engagement with the adjustment screw 30. The stop nut 51 shall here be at a certain distance, for example 28 mm, from the shoulder 48 on the adjustment screw 30 in order to obtain a suitable secondary clearance angle. The stop nut 51 is in FIG. 14 shown with a sleeve 51', which is directed towards the shoulder 48 on the adjustment screw 30 and which will establish said distance.

The base plate 14 is now rotated in the clockwise direction, until the drill point again gets in contact with the grindstone 12, and locked.

The stop nut 51 is advanced on the adjustment screw 30 (in the direction towards the grindstone 12), while the adjustment screw is still locked by the locking nut 50. In a first stage the stop nut advancement can be limited to a half or a full revolution.

The grindstone revolution is again started. The sharpening process for the secondary clearance is commenced by pushing the guide member 15 towards the grindstone 12, at the same time as it is moved back and forth over the width of the grindstone. The first lip is sharpened, until the heel 47 contacts the stop nut 51.

The drill holder 16 is turned 180°, and the sharpening process for the second lip is carried out in the same manner as for the first one, until the heel 47 again contacts the stop nut 51.

The four facet shape is now beginning to emerge, but the secondary clearances have to be further ground, so that they meet in the centre and a real point is formed, as shown in FIG. 4.

Accordingly, the stop nut 51 is further advanced a short distance, whereupon the sharpening is performed on the two lips alternately, until the desired shape shown in FIG. 4 has been reached.

The purpose of FIG. 15 (provided with reference numerals) and 16 (not provided with reference numerals for the sake of clarity) is to further illustrate an important aspect of the drill holder 16. The drill holder 16 is transferred in the direction of the drill 1 on the front plate 22 of the guide member 15. A guide groove 39 at the right hand side of the drill holder guides against a guide ridge 28 on the front plate 22. The left hand side of the drill holder slides without guiding on the support strip 40. When the drill holder 16 is turned 180°, as is illustrated in FIG. 16, its second guide groove 39 guides the drill holder on the same guide ridge 28, so that the point of the drill 1 obtains exactly the same position against the grindstone 12.

The two heels 47, which are positioned symmetrically on either side of the drill holder 16, ensure in their engagement with the shoulder 48 on the adjustment screw 30 that the two cutting lips of the drill 1 are ground symmetrically.

Modifications are possible within the scope of the appended claims.

The invention claimed is:

1. A device for sharpening a twist drill point by means of a rotating grindstone in a grinding machine, wherein the combination of a base plate lockably articulated around an axis parallel with the axis of the grindstone, a drill holder for holding a twist drill (1) to be sharpened, and a guide member, comprising a back plate and a front plate, lockably rotatable in relation to each other, the back plate being connected to the base plate for movements in the direction of the grindstone axis, and the front plate having guide means for slidably guiding the drill holder in the general direction towards and away from the grindstone.

2. A device according to claim 1, wherein the base plate has a longitudinal bore for a cylindrical support bar of the grinding machine, a locking screw being engageable in the bore, and wherein the base plate has a support ridge for sliding cooperation with a guide groove on the lower side of the back plate.

3. A device according to claim 1, wherein the front plate of the guide member has a guide ridge for cooperation with a guide groove (39) in the drill holder and a guide plane for cooperation with a support strip on the drill holder.

4. A device according to claim 1, wherein the drill holder comprises two clamping members, between which the twist drill may be clamped by means of a screw, and is provided with guide grooves and support faces on two opposed surfaces for enabling a turning 180°.

5. A device according to claim 1, wherein the back plate and the front plate of the guide member may be locked together by means of a back plate screw, the front plate having a sight hole for showing angle numbers provided on the back plate.

6. A device according to claim 1, wherein an adjustment screw provided on the front plate in parallel with the guide ridge has a fixed shoulder and a movable stop nut for cooperation with a heel on either side of the drill holder.

7. A device according to claim 1, wherein a template is used for determining the angular position of the base plate with the guide member.

8. A method for sharpening a twist drill point by means of a device according to claim 1, wherein comprising the following steps: after mounting on the cylindrical support bar parallel with the axis of the grindstone, the base plate is provided with the slidable guide member, and their angular position in relation to the grindstone, determining the primary clearance angle of the twist drill to be sharpened, is set by means of the template and locked, the desired point angle of the drill to be sharpened is determined by rotating the front plate of the guide member in relation to its back plate and locking it in the chosen position, the twist drill is mounted in the drill holder with its cutting lips in parallel with the side surfaces of the drill holder, and the drill holder is placed on the guide member with its heel in contact with the shoulder on the adjustment screw in a position where the drill point contacts the grindstone, after advancement of the adjustment screw shoulder a distance corresponding to the desired cutting depth, one of the cutting lips is sharpened by pushing the drill holder towards the grindstone, while moving the drill point back and forth over the width of the grindstone, until the heel has reached contact with the shoulder (48), and the drill holder is turned around and returned to the guide member, whereupon the above sharpening procedure is repeated.

9. A method according to claim 8, wherein the following steps for obtaining a four facet sharpening are performed: the base plate is lifted somewhat to form a greater angle with the tangent of the grindstone and locked in the new position, the drill holder is lifted and placed in a new position on the guide member with the heel in contact with the stop nut, a sharpening process for forming a secondary clearance at one of the cutting lips is performed, the drill holder is turned, and the sharpening process is repeated for the other cutting lip, and the above process is repeated, until the secondary clearances meet in the centre and a real drill point is created.

* * * * *